US006169531B1

(12) United States Patent
Verhulst

(10) Patent No.: US 6,169,531 B1
(45) Date of Patent: Jan. 2, 2001

(54) LIQUID-CRYSTAL CONTROL CIRCUIT DISPLAY DEVICE WITH SELECTION SIGNAL

(75) Inventor: Antonius G. H. Verhulst, Eindhoven (NL)

(73) Assignee: U.S. Philips Corporation, New York, NY (US)

( * ) Notice: Under 35 U.S.C. 154(b), the term of this patent shall be extended for 0 days.

(21) Appl. No.: 08/795,122

(22) Filed: Feb. 7, 1997

(30) Foreign Application Priority Data

Feb. 22, 1996 (EP) ..... 96200458

(51) Int. Cl.[7] ..... G09G 03/36

(52) U.S. Cl. ..... 345/94; 345/97; 345/208; 349/133; 349/172

(58) Field of Search ..... 345/92, 97, 94, 345/95, 96, 208, 210; 349/171–172, 133, 139, 42, 47–49, 52

(56) References Cited

U.S. PATENT DOCUMENTS 5,159,325 * 10/1992 Kuijk et al. ..... 345/84
5,654,784 * 8/1997 Yasuda et al. ..... 349/172
5,844,652 * 12/1998 Takatori ..... 349/139

FOREIGN PATENT DOCUMENTS 9534986 12/1995 (WO) .

OTHER PUBLICATIONS

"A Full–Color DHF–AMLCD with Wide Viewing Angle" in SID 94 Digest pp. 430–433.

J.S. Patel: "Ferroelectric Liquid–crystal Modulator using Twisted Smectic Structure".

Appl. Phys. Lett. Vol. 60(3) pp. 280–282 (1992)—H. Okado et. al: "New Display Mode of Ferroelectric Liquid Crystals with Large Tilt Angle", Ferroelectrics vol. 149, 171–181 (1993).

Appl. Phys. Lett. vol. 60(3) pp. 280–282 (1992)—D.M. Walba et al: "High Performance Electroclinic Materials", Ferroelectrics vol. 148, 435–442 (1993).

Asia Display '95 pp. 61–64.

* cited by examiner

*Primary Examiner*—Lun-Yi Lao
(74) *Attorney, Agent, or Firm*—Norman N. Spain

(57) ABSTRACT

In display devices based on ferroelectric liquid-crystal material with deformable helix, ferroelectric liquid-crystal material with a twisted smectic structure, monostable ferroelectric liquid-crystal material, electroclinic smectic A liquid-crystal material and anti-ferroelectric liquid-crystal material, the memory effect, particularly in the case of video applications, is eliminated by presenting reset pulses in successive row selection times during a part of these times (for example in the case of matrix displays based on TFTs), so that the polarization within a cell is always reduced to zero and, after selection for the purpose of writing data, switches to the proper value.

6 Claims, 3 Drawing Sheets row no
n
n+1
n+2
n+3
n+4
n+5
n+6
n+7
n+8
n+9
41
42
t $V_{col}$
43
48
44
0
t $V_{pix}$
$V_{(row\ n)}$
R
46
0
t T
0
t

LIQUID-CRYSTAL CONTROL CIRCUIT DISPLAY DEVICE WITH SELECTION SIGNAL

BACKGROUND OF THE INVENTION

The invention relates to a display device comprising a number of display elements, which are arranged in rows and columns in accordance with a matrix, and comprising, between a first substrate and a second substrate, a liquid-crystal material which belongs to the group of smectic liquid-crystal materials, which include ferroelectric liquid-crystal material with deformable helix, ferroelectric liquid-crystal material with twisted smectic structure, monostable ferroelectric liquid-crystal material, electroclinic smectic A liquid-crystal material and anti-ferroelectric liquid-crystal material, and comprising a group of row electrodes and a group of column electrodes, each pixel including, on at least one substrate, a picture electrode which is connected to a column electrode or row electrode via an active switching element, and said display device comprising means for applying selection voltages to the row electrodes and data voltages to the column electrodes.

Such display devices can be used as video displays, but also, for example, in datagraphic monitors or as view finders.

In general, a ferroelectric liquid-crystal material with a deformed helix is to be understood to mean a ferroelectric liquid-crystal material with a natural helix whose pitch is smaller than the wavelength of visible light (up to approximately 400 nm). An electric field which extends perpendicularly to the axis of the helix causes deformation of said helix, which results in rotation of the optical axis. As a result, between crossed polarizers, one of which extends parallel to the axis of the helix, the transmission increases for both positive and negative fields.

Just like the other materials mentioned hereinabove, the ferroelectric liquid-crystal material with a deformed helix exhibits a high degree of polarization in the fully driven state. If they are provided between a polarizer and an analyzer, the above-mentioned materials have another characteristic in common, namely that they can switch between substantially transparent and substantially opaque if the polarizer and the analyzer are at a specific angle with respect to each other, while intermediate levels of transparency (grey levels) can also be realized.

A display device of the type mentioned hereinabove is described in "A Full-Color DHF-AMLCD with Wide Viewing Angle" in SID 94 DIGEST pp. 430–433. According to said document, the use of devices with DHFLC material (Deformed Helix Ferroelectric Liquid Crystal) is advantageous as compared to so-called SSFLC devices (Surface Stabilized Ferroelectric Liquid Crystal) due to the absence of multidomains, while a more continuous change of the transmission voltage characteristic enables a better realization of grey levels to be achieved. Despite the high switching rate of the mixture used in the display device, the field frequency remains too low for video applications (NTSC or PAL), which is in complete opposition to the expectations based on the high switching rate of the DHFLC material. This finds its explanation in the high value of the spontaneous polarization of these materials. The customary pulse duration of drive pulses (which, in practice, is comparable to a pulse duration of the order of, for example, half the row-selection time of the drive system, which amounts, for example, in TV systems to 64 $\mu$sec.) is too short to supply the polarization current. Transient phenomena occur which may extend over a plurality of frame or field times.

In the device described in the above-mentioned document, also "image sticking" (image retention) occurs. The other above-mentioned liquid-crystal effects with a high degree of polarization exhibit the same problems, while the degree of polarization increases as the electric field increases. In general, the voltage/transmission curve for positive and negative voltages is symmetrical. Examples of such effects are described in

- J. S. Patel: "Ferroelectric Liquid-crystal Modulator using Twisted Smectic Structure", Appl. Phys. Lett. Vol. 60(3) pp. 280–282 (1992)
- H. Okado et al: "New Display Mode of Ferroelectric Liquid Crystals with Large Tilt Angle", Ferroelectrics Vol. 149, 171–181 (1993),
- D. M. Walba et al: "High Performance Electroclinic Materials", Ferroelectrics Vol. 148, 435–442 (1993).

Yet another example is the anti-ferroelectric liquid-crystal effect, as described, for example, in Asia Display '95 pp. 61–64.

It is one of the objects of the invention to provide, inter alia, a display device of the type mentioned in the opening paragraph, which can operate at field frequencies in excess of 20 Hz (for example 50 Hz (PAL)).

Another object of the invention is to provide a device in which little, if any, "after image" occurs.

To this end, a display device in accordance with the invention is characterized in that the display device comprises a control circuit which, during a first part of a line-selection time, provides a first number of successive row electrodes with a selection signal for the purpose of reset and which, during a corresponding part of a subsequent line-selection time, provides a second number of successive row electrodes, yet shifted by at least one line position, with a selection signal for the purpose of reset and which, during another part of a line-selection time, provides one or two row electrodes with a selection signal for the purpose of writing data and which provides the column electrodes with data signals.

In this context, "successive row electrodes" can also be understood to mean a number of row electrodes at one extreme edge (for example the last row electrodes) together with a number of row electrodes at the other extreme edge (for example the first row electrodes). In specific applications (double row drive), the even fields and the odd fields, for example, of a television picture are partly interlaced. The type of application determines whether selection offset by one or two line positions takes place and whether, during other parts of a line-selection time, one or two row electrodes are provided with a selection signal for writing data.

The invention is based on the recognition that, unlike known (ferroelectric) liquid-crystal display devices, upon application of a voltage across a pixel, the spontaneous polarization of DHFLC materials (and the other materials mentioned hereinabove) plays such an important part that either it requires such a long time that the display device as a whole becomes too slow or the pixel does not always receive the desired charge and the associated transmission value. In the above-mentioned article, it is proposed to bring a row of display elements to an extreme optical transmission state by means of an auxiliary voltage (reset), prior to selection, but also in this case the pixel does not always receive the desired charge owing to the great importance of the polarization, so that incomplete reset occurs. As the charge (and hence the transmission value) across the pixel is undefined again after this reset, the data signal provided in a subsequent selection process will not lead to the intended final value of the charge (and hence of the transmission value) across the pixel, etc. Even in the case of an identical grey level of the pixel to be written over a period covering a plurality of field times, it may take a number of field times to eliminate this "memory effect".

In a display device in accordance with the invention, the "memory effect" is eliminated at least substantially by providing the pixels in a first number of successive rows with a reset signal during a first part of the line-selection time, repeating this in subsequent line-selection times for a second number of successive rows, yet shifted by at least one line position, and providing the column electrodes with data signals during every second part of the line-selection time. In this case, the joint effect of the reset signals presented during the first parts of the number of successive line-selection times is sufficient, if the numbers are suitably chosen, to achieve a complete reset.

Preferably, resetting causes the pixels to switch to an opaque state, which results in a better contrast.

If the active switching element is, for example, a TFT, each pixel can be provided with an additional capacitor. The charge stored on the additional capacitor during the selection period (which can be much shorter now) also determines the charge across the pixel (and hence the polarization).

These and other aspects of the invention will be apparent from and elucidated with reference to the embodiments described hereinafter.

DESCRIPTION OF THE PREFERRED EMBODIMENTS

Figure 1:
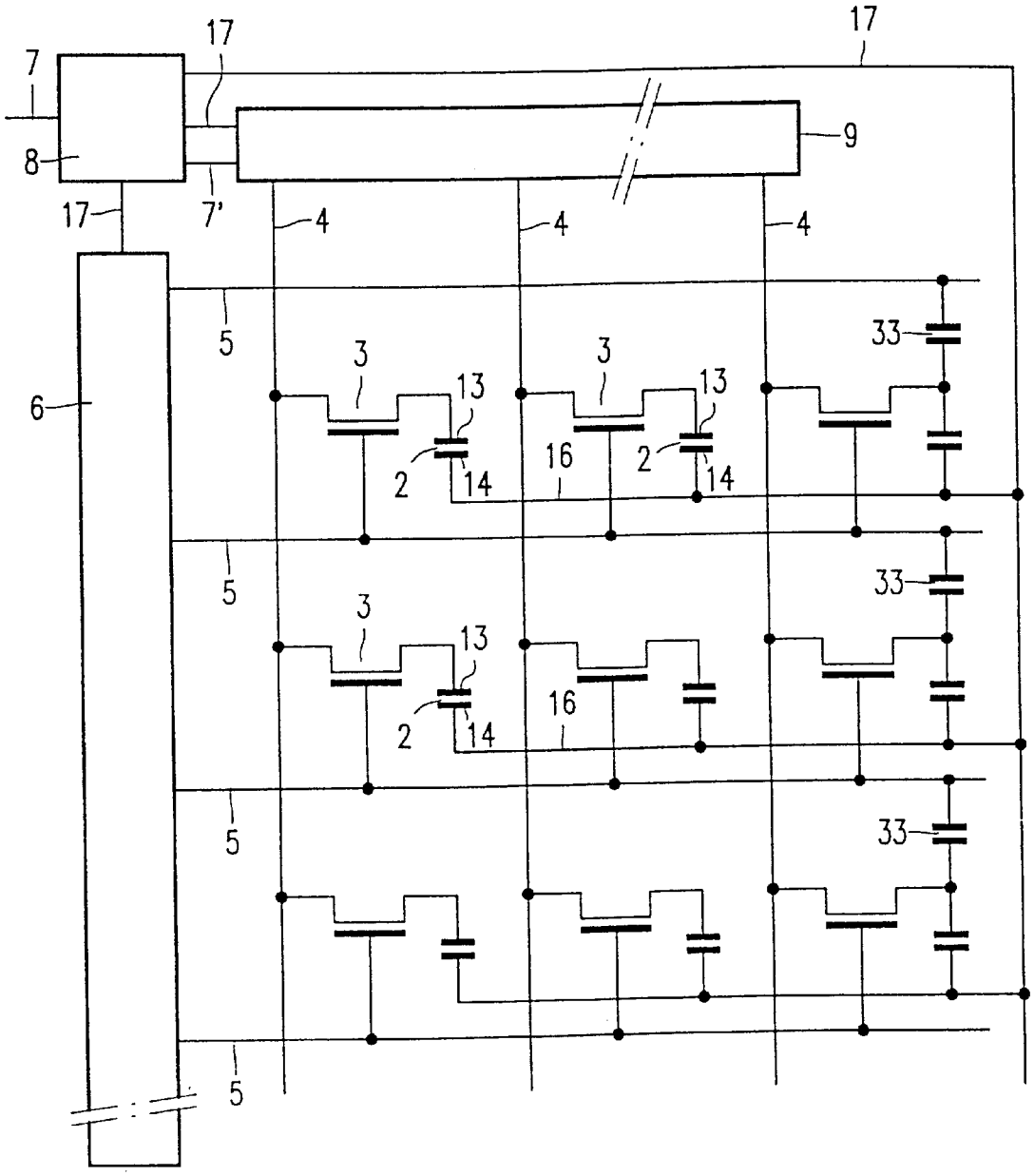
FIG. 1 schematically shows an electrical equivalent circuit diagram of a part of a display device in accordance with the invention, FIG. 2 schematically shows a cross-section of the device shown in FIG. 1, FIG. 3 schematically shows the position of the polarizers relative to the helix (FIG. $3^a$) and a transmission voltage characteristic (FIG. $3^b$) of a device in accordance with the invention, FIG. 4 schematically shows a number of different voltage curves and the associated polarization and transmission curves for the device shown in FIG. 1, which is operated in accordance with the invention.

FIG. 1 schematically shows an electrical equivalent circuit diagram of a part of a display device 1. This device includes a matrix of pixels 2 which are arranged in rows and columns. In this example, the pixels 2 are connected to column electrodes or data electrodes 4 by means of three-pole switches, in this example TFT transistors 3. A row of pixels is selected via row or selection electrodes 5 which select the relevant row via the gate electrodes of the TFTs. The row electrodes 5 are successively selected by means of a row-drive circuit 6.

Incoming data signals or (video) information 7 are processed in a processing/control unit 8 and stored in a data register 9. The voltages provided by the data register 9 cover a voltage range which is sufficient to set the desired range of grey levels. Pixels 2, in this case represented by capacitors 2, are charged positively or negatively via the TFTs 3 as a result of the fact that, during selection, the picture electrodes 13 take over the voltage from the column electrodes. In this example, the picture electrodes 14 form a common counter electrode, which is referenced 16. Synchronization of said picture electrodes takes place via control lines 17.

If necessary, each pixel may also be provided with an auxiliary capacitor 33. Said auxiliary capacitors 33 (shown for only one column in FIG. 1) reduce the voltage loss across the pixels. Said auxiliary capacitors have a capacitance value which is approximately 10 times (5 to 20 times) as high as that of a pixel.

By using active switching elements, it is precluded that signals on the column electrodes intended for other pixels affect the setting of the voltage across the pixels before these pixels are selected again (in a subsequent (sub-)field).

Figure 2:
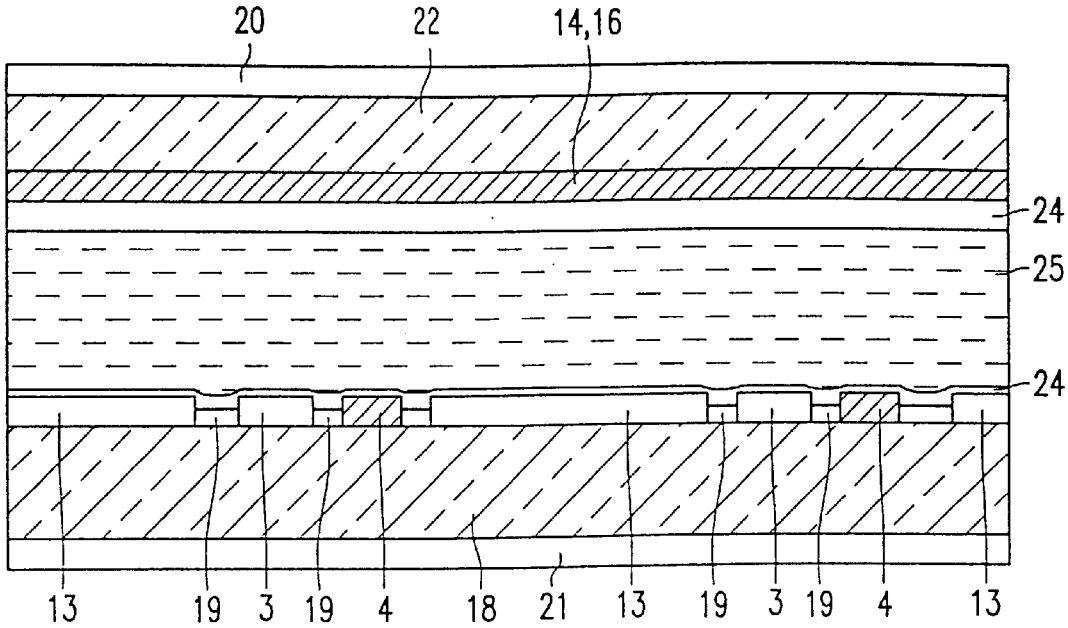

FIG. 2 is a schematic, cross-sectional view of the device shown in FIG. 1. On a first substrate 18, there are row or selection electrodes (not shown), as well as column or data electrodes 4 and picture electrodes 13, which are made, in this example, of a transparent, conductive material such as indium-tin oxide, which electrodes are connected to the column electrodes 4 via the TFTs 3 by means of (schematically shown) connections 19.

On a second substrate 22 there are picture electrodes 14, which, in this example, are integrated to form a common counter electrode 16. Both substrates are further covered with orienting layers 24, while a ferroelectric liquid-crystal material with a deformable helix 25 is situated between the substrates. Any spacers and the sealing edge are not shown. The device further comprises a first polarizer 20 and a second polarizer or analyzer 21 whose polarization axes intersect at right angles.

Figure 3A:
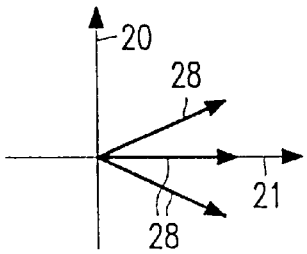
Figure 3B:
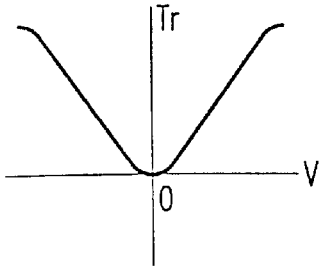

FIG. 3 schematically shows a transmission/voltage characteristic (FIG. $3^b$) of a cell in such a device, in which, due to the absence of the electric field, the axis of the helix (and hence the optical axis 28) of the DHFLC material is chosen to extend parallel to one of the polarizers (see FIG. $3^a$), the so-called symmetric mode. As a result of an applied electric voltage across the cell, the molecules try to direct their spontaneous polarization towards the associated field, which leads, between crossed polarizers with the axis of the helix extending parallel to one of the polarizers, to a transmission/voltage characteristic which exhibits an increase in transmission for positive and negative voltages as the voltage increases (FIG. $3^b$). However, the invention can also be applied in the so-called asymmetric mode in which the crossed polarizers are rotated relative to the substrates in such a manner that the optical axis of the helix of the DHFLC material coincides in the driven state with one of the directions of polarization.

FIG. $4^a$ schematically shows the voltage variation on a number of row electrodes 5 of the device shown in FIGS. 1, 2, and FIG. $4^b$ shows the voltage variation on a random column electrode 4. During the first part $t_r$ of a line time $t_l$, a pulse 41 for the purpose of reset is presented to row n, while the voltage on the column electrode is, in this example, approximately 0 volt. During the second part $t_w$ of the relevant line time $t_l$, the row n is not selected, while the voltage on the column electrode is determined by the information which is written on a row which is not shown. In practice, the values of $t_l$, $t_r$ and $t_w$ are chosen to be such that $t_r+t_w \leqq t_l$.

Figures 4A, 4B, 4C, 4D:
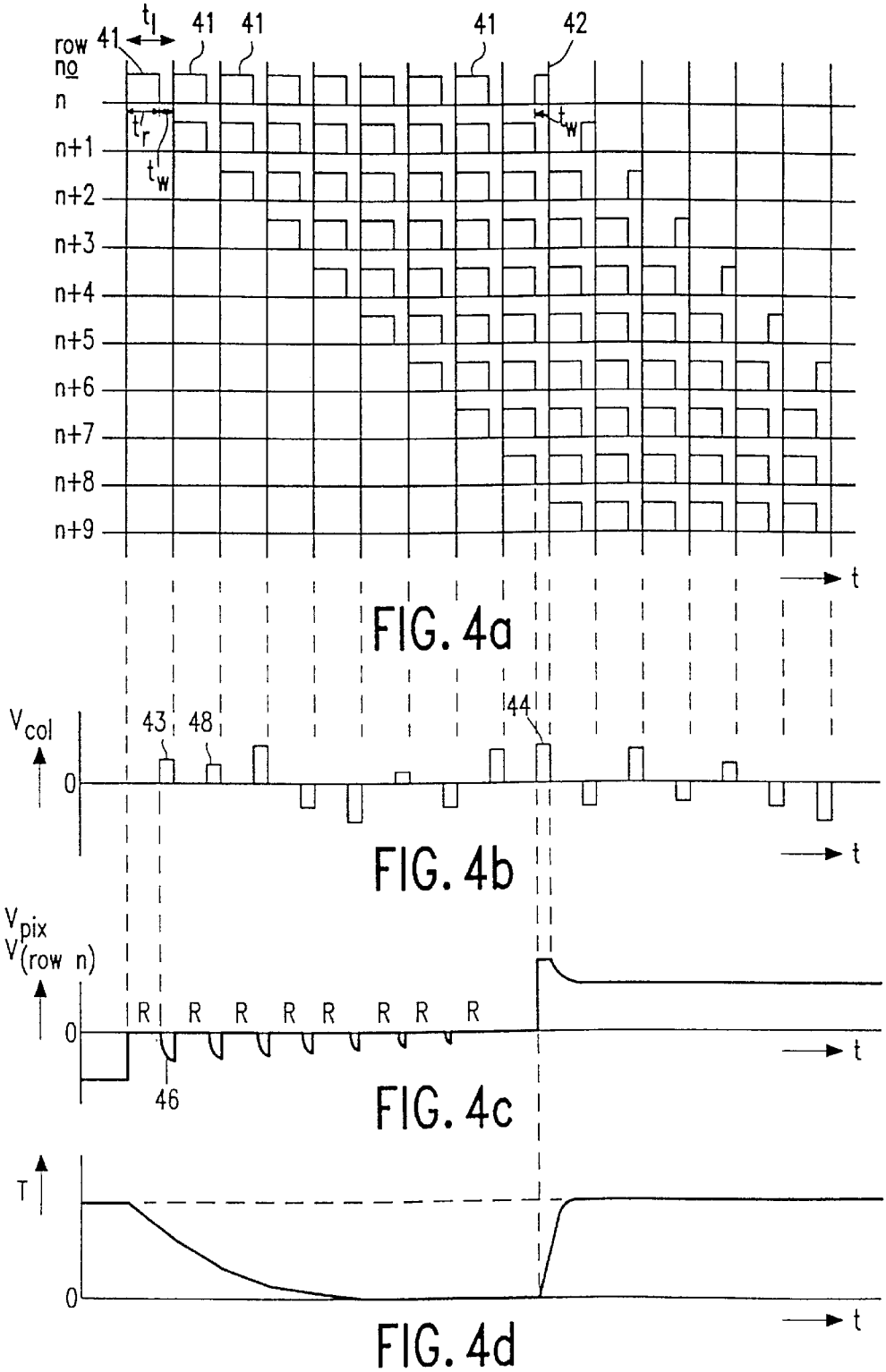

To this end, the data register 9 is designed in such a manner that it provides the column electrodes, during the first part $t_r$ of the row-selection period $t_l$, with a voltage of approximately 0 volt and, during the second part $t_w$ of the relevant line time $t_l$, with the data voltages (column voltages), indicated as pulses 43, intended for the selected row. The counter electrode 16 has a voltage of approximately 0 volt. During a number (in this example 8) of successive line times, the row-drive circuit provides the row n with selection pulses 41 for the purpose of reset and, in a subsequent (or a later) line time during the second part of the line time, with a selection pulse 42 for writing. If necessary, the last selection pulse 41 for the purpose of reset in row n and the selection pulse 42 for the purpose of writing, which are presented in different line times in FIG. 4$^a$, may take place within one line time, if necessary. The pulse 44 on the relevant column electrode 4 defines the voltage across the pixel selected in row n (FIG. 4$^c$) and the associated transmission (FIG. 4$^d$).

A striking feature in this connection is that in a number (in this case 8) of successive line times a complete reset (pixel voltage 0 volt and zero transmission) is achieved via a number of intermediate values. After a first reset, the cell having a cell capacitance $C_0$, for example, has a voltage $V_0$, which corresponds to a charge $Q=C_0.V_0$. During the subsequent write time the charge supplies a polarization current in the same row selection time, which current gives rise to the voltage curve 46 as shown in FIG. 4$^c$. During a subsequent row selection time, the reset pulse brings about a further reduction of the voltage amplitude until after (in this example) 8 row selection times a complete reset has taken place and the voltage determined by pulse 44 on the relevant column electrode 4 is written across the pixel selected in row n. Thus, complete reset is achieved in a period of time which is much shorter than the actual field time or frame time. As a result, the memory effect mentioned in the opening paragraph is eliminated. In addition, immediately after its selection, a pixel receives the desired voltage (and transmission value), so that aftereffects do not occur.

To preclude undesirable charge effects, the cell of the device shown in FIGS. 1, 2 is preferably driven with voltages of opposite sign. Consequently, prior to reset, the voltage across the selected pixel is of opposite sign to the voltage after writing. For the rows n+1, n+2, . . . the same pulse pattern is applied to the row electrodes as to the row n, yet shifted by one row selection time. The number of pulses necessary for reset is also governed by the liquid-crystal material used and by the utilization, or not, of an auxiliary capacitor 33, and it can be influenced by varying the duration of these pulses.

Of course the invention is not limited to the exemplary embodiments described herein, and within the scope of the invention a number of variations are possible. For example, both reflective and transmissive display devices can be used. The number of row electrodes which is provided with a reset pulse during one line time may vary, even within one display device, for example as a result of transient effects, or by commencing writing a new image in the case of "double row drive" or, for example, because a slightly longer reset action is locally necessary. Alternatively, a first part of the line time can be used for selection for the purpose of writing, while during the second part of the line time a signal for the purpose of reset is continuously being energized.

In an advantageous, alternative embodiment, the voltage of a counter electrode situated on the second substrate can alternate every field time with respect to an average voltage. By virtue thereof, lower drive voltages and hence cheaper ICs can be used. In this case, the drive circuit advantageously applies a voltage to the column electrodes, during the provision of a selection signal for reset, which voltage is substantially equal to that of the counter electrode.

In summary, the invention makes it possible to eliminate the memory effect in Deformed Helix Ferroelectric liquid-crystal display devices and liquid-crystal display devices based on similar materials (high polarization in the fully driven state), in particular in video applications, by presenting reset pulses in successive row selection times during a part of these times (for example in matrix displays based on TFTs), so that the polarization within a cell is always reduced to zero and, after selection for writing data, switches to the correct value.

What is claimed is:

1. A display device comprising a number of display elements, which are arranged in rows and columns in accordance with a matrix, and comprising, between a first substrate and a second substrate, a liquid-crystal material which belongs to the group of smectic liquid-crystal materials, which include ferroelectric liquid-crystal material with deformable helix, ferroelectric liquid-crystal material with twisted smectic structure, monostable ferroelectric liquid-crystal material, electroclinic smectic A liquid-crystal material and anti-ferroelectric liquid-crystal material, and comprising a group of row electrodes and a group of column electrodes, each pixel including, on at least one substrate, a picture electrode which is connected to a column electrode or row electrode via an active switching element, and said display device comprising means for applying selection voltages to the row electrodes and data voltages to the column electrodes, characterized in that the display device comprises a control circuit which, during a first part of a line-selection time, provides a first number of successive row electrodes with a selection signal for the purpose of reset and which, during a corresponding part of a subsequent line-selection time, provides a second number of successive row electrodes, but shifted by at least one row position, with a selection signal for the purpose of reset and which, during another part of a line-selection time, provides one or two row electrodes with a selection signal for the purpose of writing data and which provides the column electrodes with data signals.

2. A display device as claimed in claim 1, characterized in that during a first part of a line-selection time and during a corresponding part of a subsequent line-selection time, the control circuit provides a same number of successive row electrodes, but shifted by at least one row position with a selection signal for the purpose of reset.

3. A display device as claimed in claim 1, characterized in that during providing a selection signal for the purpose of reset, the control circuit provides the column electrodes with a voltage of approximately zero volt.

4. A display device as claimed in claim 1, characterized in that the active switching element is a TFT on the first substrate, and the control circuit comprises means for causing the voltage of a counter electrode situated on the second substrate to alternate every field time relative to an average voltage.

5. A display device as claimed in claim 4, characterized in that during the provision of a selection signal for the purpose of reset, the control circuit provides the column electrodes with a voltage which is approximately equal to that on the counter electrode.

6. A display device as claimed in claim 1, characterized in that each pixel is provided with an additional capacitor.

* * * * *